US005233763A

United States Patent [19]

Minnie, Jr.

[11] Patent Number: 5,233,763

[45] Date of Patent: * Aug. 10, 1993

[54] SLUDGE DRYING APPARATUS

[76] Inventor: Clarence O. Minnie, Jr., 27735 Sylvan Dr., Warren, Mich. 48093

[ * ] Notice: The portion of the term of this patent subsequent to Mar. 28, 2006 has been disclaimed.

[21] Appl. No.: 627,261

[22] Filed: Dec. 14, 1990

[51] Int. Cl.[5] ..... F26B 3/34

[52] U.S. Cl. ..... 34/1 X; 110/223; 110/257; 110/228; 432/59; 432/72; 34/219; 34/68; 34/17

[58] Field of Search ..... 34/1 W, 1 X, 203, 218, 34/219, 223, 230, 68, 17, 4, 39; 110/227, 228, 248, 257, 224, 223, 255; 432/72, 59

[56] References Cited

U.S. PATENT DOCUMENTS

| | | | |
|---|---|---|---|
| 2,481,504 | 9/1949 | Ferro et al. | 110/257 |
| 2,771,847 | 11/1956 | Holbrook | 110/257 |
| 3,289,617 | 12/1966 | Simpson | 110/257 |
| 3,841,242 | 10/1974 | Sigg | 110/257 |
| 3,861,331 | 1/1975 | Saith et al. | 110/257 |
| 3,871,286 | 3/1975 | Heatiksen | 110/257 |
| 3,917,445 | 11/1975 | Suva et al. | 432/141 |
| 4,047,884 | 9/1977 | Heian | 432/72 |
| 4,091,748 | 5/1978 | Mansfield | 110/228 |
| 4,443,185 | 4/1984 | Smith | 432/72 |
| 4,715,810 | 12/1987 | Ramsey et al. | 432/59 |
| 4,815,397 | 3/1989 | Minnie, Jr. | 110/223 |

*Primary Examiner*—Henry A. Bennet

*Assistant Examiner*—Denise L. Gromada

*Attorney, Agent, or Firm*—Brooks & Kushman

[57] ABSTRACT

A sludge drying apparatus (10) including a housing through which air is recirculated wherein makeup air forms an air curtain assuring recirculation of heated air. The housing (12) includes a receiving station (14) in which sludge (20) is deposited on a conveyor belt (18). The conveyor belt (18) moves the sludge (20) to a drying station (16) where infrared heaters (42) radiate infrared heat on the sludge. Air for drying the sludge circulates from a fan plenum (28) to an air supply plenum (24). Air from the air supply plenum (24) passes across the face of the infrared heaters (42), and is directed downwardly toward the sludge (20) in a belt passageway (30). Air is returned through a return air plenum (26) located below the belt passageway (30). Part of the air received by the return air plenum (26) is ported directly from the belt passageway (30) to the return air plenum (26). Additional air is received in the return air plenum (26) through first and second return air ducts (36) and (38) located at the entrance opening (32) of the belt passageway (30) and the exit opening (34) of the belt passageway (30). Ambient air flows into the first and second return air ducts (36) and (38) as well as the air received through the entrance and exit openings (32) and (34) of the belt passageway (30). Ambient air received in the return air ducts forms an air curtain effectively sealing the ends of the belt passageway (30).

10 Claims, 3 Drawing Sheets

SLUDGE DRYING APPARATUS

TECHNICAL FIELD

The present invention relates to a sludge drying apparatus and more particularly relates to such apparatus wherein sludge is conveyed on a porous screen. More particularly, radiant energy and heated air are directed toward the sludge to remove water and volatile organics leaving a dried particulate residue.

BACKGROUND ART

A problem facing many manufacturing and industrial facilities is efficient and economical disposal of waste products. Many waste products in manufacturing operations are aqueous or organic solvent semi-solid solutions commonly referred to as sludge. A dramatic reduction in volume of sludge can be realized by drying the sludge to dry water and solvents.

In my prior art patent, U.S. Pat. No. 4,815,397, entitled Sludge Treatment Apparatus, I proposed a sludge drying apparatus in which sludge is conveyed on a screen conveyor in close proximity to ceramic thermal reactors. Ambient air is drawn through each reactor by a fan which directs air across a pair of ceramic burners. The pair of ceramic burners of each reactor are separated from adjacent reactors. Air drawn through the sludge and screen conveyor is supplied to the sludge inlet area in an attempt to preheat the sludge. One problem regarding this apparatus is its low energy efficiency. Also, air directed toward the incoming sludge was not contained within the unit, and resulted in unacceptable levels of particulate and combustion byproducts being released into the environment around the sludge treatment apparatus.

The throughput or drying capacity of the prior sludge drier was limited in capacity to approximately 35 pounds per hour. Running the drier at higher throughput rates was not possible due to uneven heating and inefficient operation of thermal reactors. To achieve optimum drying, a substantially uniform temperature profile should be maintained in the drier. In addition to a uniform temperature profile, uniform air flow in the drier section improves overall drying efficiency. It has been found that uniform temperature conditions and air flow were not possible with the use of individual thermal reactors operating independently of each other. Effective recirculation of heated air was not achieved by the prior apparatus.

These and other problems relating to the prior art are addressed by the present invention.

DISCLOSURE OF INVENTION

According to the present invention, a sludge drying apparatus is provided in which sludge is deposited on an endless belt conveyor which moves sludge generally horizontally through a housing. The belt is a porous screen and is driven by a power drive. An upper run of the belt has a receiving station on which sludge is deposited. Within the housing, air is directed in a substantially recirculating path. A portion of the air circulated in the apparatus is vented from the apparatus and is replaced by an equivalent volume of makeup air. An upper plenum is pressurized by a fan which directs air and other gases contained within the housing through a supply duct to the upper plenum. A plurality of thermal reactors are disposed in a lower wall of the upper plenum and directly above a major portion of the upper run of the belt. The thermal reactors direct radiant energy toward the sludge carried by the upper run of the belt. Air exits the upper plenum through openings formed in the lower surface of the upper plenum. The thermal reactors are mounted adjacent the openings in the lower wall of the upper plenum with clearance therebetween for air to flow across the face of the thermal reactors. Air passing the face of the thermal reactors is heated and then flows either through the sludge and screen or over the surface of the sludge. A lower plenum is provided below the upper run of the belt. The lower plenum is maintained as a vacuum to draw air through the sludge. Only a portion of the air is drawn through the sludge with the balance of the air exiting from the entrance and exit of the belt passageway in the drying chamber. Return ducts opening into the entrance and exit of the belt plenum provide a partial vacuum at the entrance and exit through which heated air is pulled from the entrance and exit ends of the belt. Makeup air is also drawn from the outside of the entrance and exit ends and through the return duct to create an air curtain effect at the entrance and exit of the belt passageway. The return ducts are open to the negative pressure side of a fan provided in a fan plenum of the apparatus. After being acted on by the fan, air is directed back to the upper plenum.

According to another aspect of the present invention, balanced air flow is returned from the entrance and exit of the belt passageway. Balanced air flow aids in maintaining air flow across the length of the belt setting up circulation from the thermal reactors across the top of the sludge and to the entrance and exit of the belt passageway.

As drying progresses, air in the apparatus becomes saturated with moisture. It is therefore desirable to vent a portion of the air to eliminate moisture from the system. Air is preferably vented from the upper plenum to atmosphere, generally through a scrubber or other exhaust processing equipment. Air is drawn into the system through the return ducts located at the entrance and exit of the belt passageway, and air drawn in from the exterior creates an air curtain which substantially seals the entrance and exit of the belt passageway so that heated air remains within the apparatus.

A portion of the air is exhausted from the upper plenum to eliminate moisture from the apparatus. This portion of air is made up by drawing air from the entrance and exit of the belt passageway. Between 10 and 30 percent of the air recirculated by the fan to the upper plenum is allowed to leave the apparatus. An equivalent amount of air is drawn into the apparatus through the entrance and exit of the belt passageway. Consequently, between 70 and 90 percent of the heated air is recirculated resulting in substantial thermal savings.

According to another aspect of the invention, a filter is provided in the fan plenum to filter particulates from the recirculated air flow. The filter is preferably a high temperature oven type filter which may be cleaned or otherwise renewed periodically.

According to another aspect of the invention, sludge is deposited in a receiving station. The receiving station is protected by a feed grate upon which the sludge is deposited generally by gravity from a drum or other material handling apparatus. After the sludge flows through the feed grate, it is deposited on the belt conveyor. A weir is preferably provided to rake the upper surface of the sludge into a level condition to optimize heating and consequently optimize removal of moisture from the sludge. In the receiving station, a portion of the water contained in the sludge is removed by gravity as water flows through the screen forming the endless belt to a drain located below the receiving station.

It is an object of the invention to provide a system in which a significant portion of heat energy is recycled through the drier to conserve energy.

It is another object of the invention to provide a sludge drying apparatus having air curtain seals which prevent heated air from escaping the apparatus and also prevent escape of fumes or gases from the system.

It is another object of the invention to maintain the balanced air flow across a plurality of thermal reactor catalyst heads wherein a uniform pressure differential is maintained across whatever number of thermal reactors required.

It is another object of the invention to provide a sludge drying apparatus in which ambient air around the apparatus is cleaned by the system due to the constant drawing in of air to replace air vented through an exhaust system.

It is another object of the invention to provide an efficient sludge drying apparatus for drying sludges including but not limited to paint sludge, municipal waste sludge, organic sludge, brewery sludge, plating hydroxide sludge, bakery sludge and other waste streams.

These and other objects and advantages of the present invention will be better understood in view of the attached drawings and following detailed description of the best mode of practicing this invention.

BEST MODE(S) FOR CARRYING OUT THE INVENTION

Figure 1:
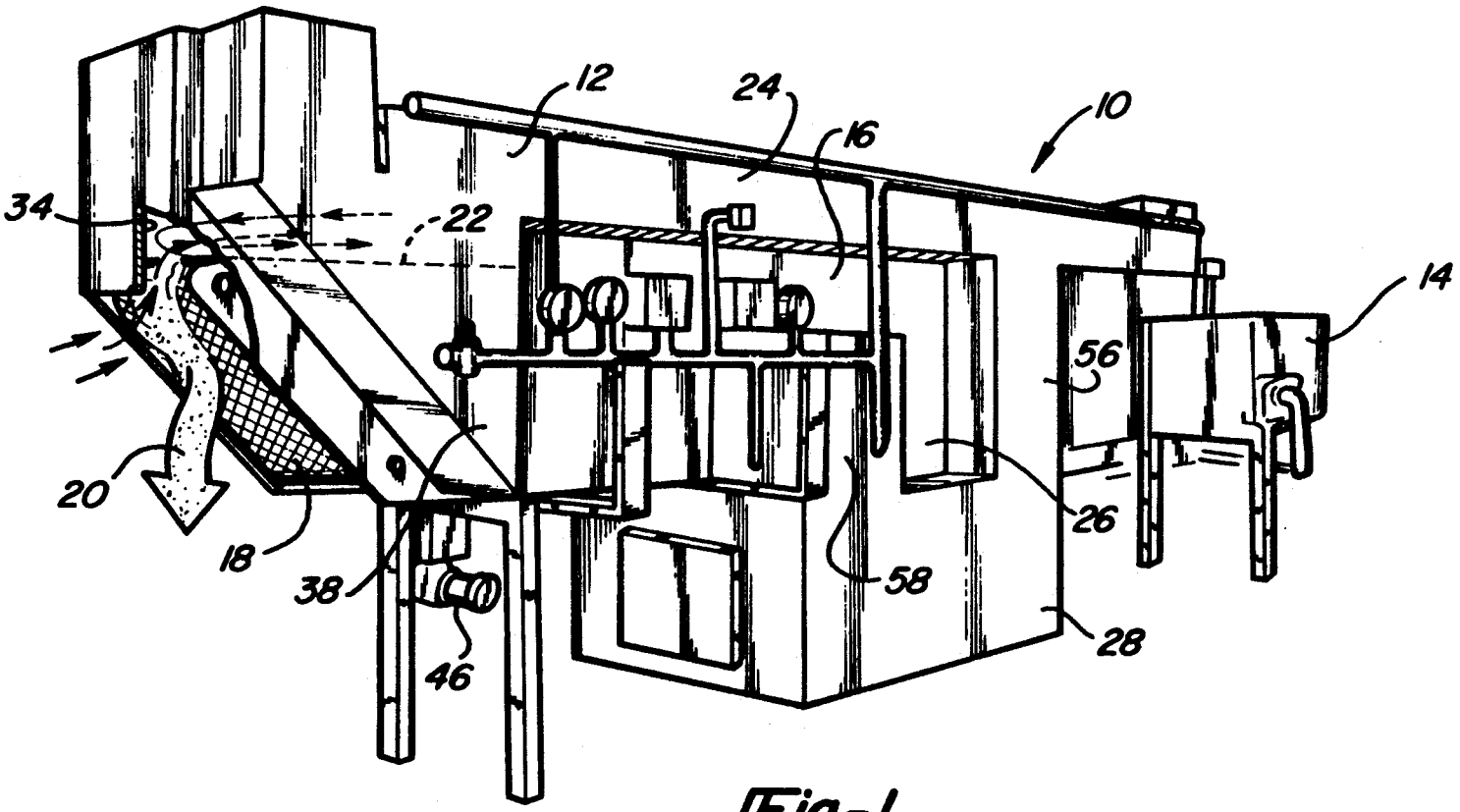
FIG. 1 is a perspective view showing all of the improved sludge drying apparatus of the present invention.
Figure 2:
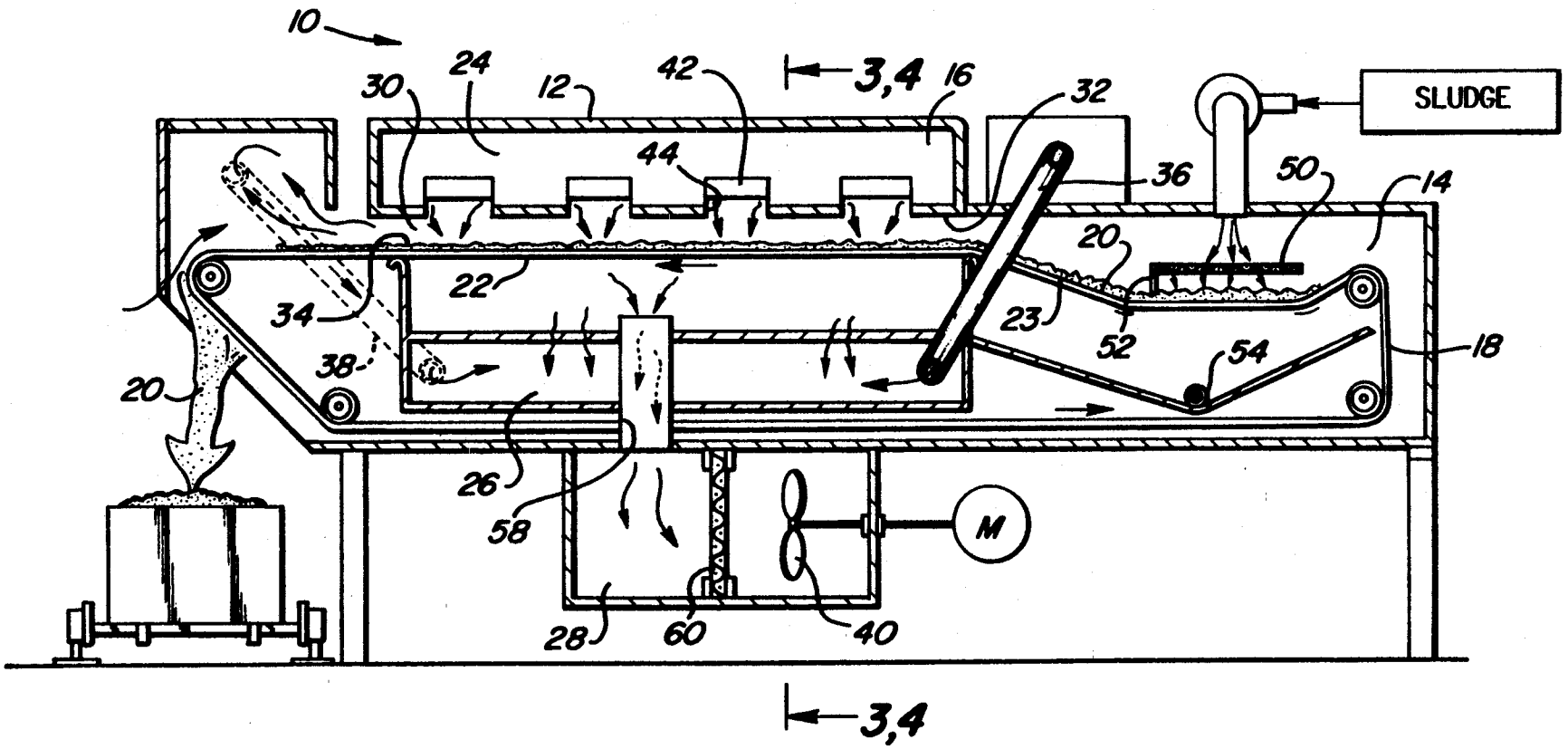
FIG. 2 is a longitudinal cross-section view of the improved sludge drying apparatus of the present invention.
Figure 3:
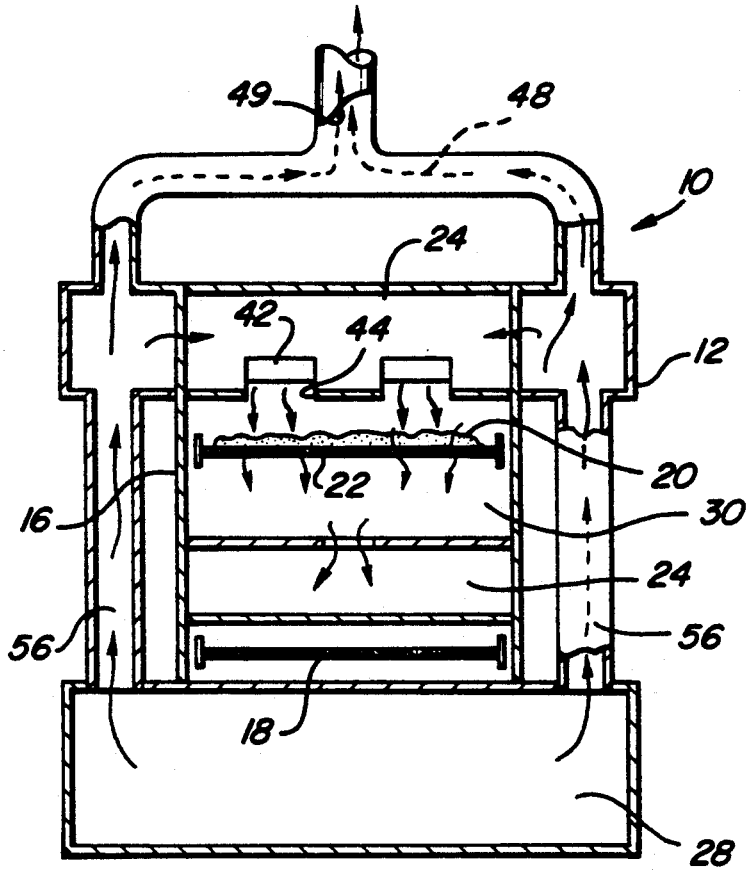
FIG. 3 is a cross-sectional view taken along the line 3—3 in FIG. 2 showing the positive pressure air flow.
Figure 4:
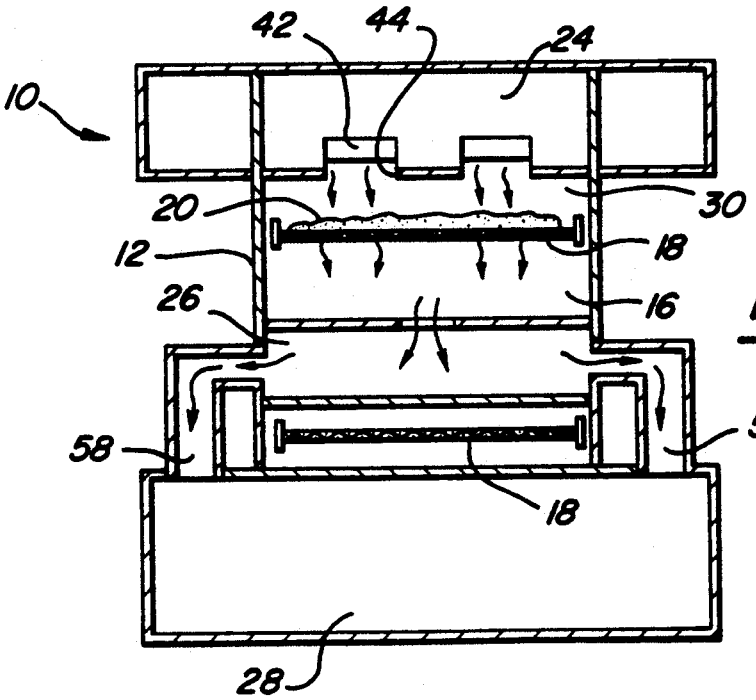
FIG. 4 is a cross-sectional view taken along the line 3—3 in FIG. 2 showing return air flow.

Referring now to FIGS. 1-4, the sludge drying apparatus 10 of the present invention is shown. The sludge drying apparatus 10 is enclosed by housing 12. Housing 12 includes a receiving station 14 and a drying station 16. Sludge 20 is deposited on a conveyor belt 18 in the receiving station 14 and moved by the conveyor belt 18 through the drying station 16. Sludge 20 is deposited on the upper run 22 of the conveyor belt 18. An inclined section 23 of the upper run 22 is provided between the point in the receiving station 14 where the sludge 20 is deposited and the drying station 16. The inclined portion 23 of the belt is provided to prevent water from flowing into the drying station.

The air recirculation system of the sludge drying apparatus 10 includes an air supply plenum 24 in which pressurized air is introduced. Air supply plenum 24 is located in the upper portion of the housing 12 above the conveyor belt 18. A return air plenum 26 is located in the lower portion of the housing 12, and is located immediately below the upper run 22 of the conveyor belt 18. Fan plenum 28 may be located in various locations but is preferably located below the return air plenum 26. The fan plenum 28 interconnects the return air plenum 26 and the supply air plenum 24 so that air drawn from the return air plenum 26 and supplied to the air supply plenum 24. A belt passageway 30 is defined in the housing between the air supply plenum 24 and the return air plenum 26. The upper run 22 of the conveyor belt 18 passes through the belt passageway 30.

A drying station entrance opening 32 is provided at the end of the belt passageway 30 adjacent the receiving station 14. A drying station exit opening 34 is provided at the opposite end of the belt passageway 30 from the receiving station 14. A first air return duct 36 extends from the drying station's entrance opening 32 to the return air plenum 26. Similarly, a second return air duct 38 extends from the drying station exit opening 34 to the return air plenum 26. Approximately equal volumes of air are drawn through the first and second return air ducts 36 and 38. A portion of the air drawn in through the first and second return air ducts 36 and 38 is obtained from ambient air surrounding the sludge drying apparatus 10. Another portion of the air drawn in by the return air duct comprises air flowing over the top of the sludge 20 on the upper run 22 of the conveyor belt 18. The air flowing over the sludge 20 is heated air received from the air supply plenum 24.

Air is circulated in the housing 12 by means of a fan 40 disposed in the fan plenum 28. Fan 40 draws air through the return air plenum 26 and forces it into the air supply plenum 24.

A plurality of infrared heaters 42 are disposed in the lower wall of the air supply plenum 24 immediately above the conveyor belt 18. The infrared heaters 42 are mounted over openings 44 in the lower wall of the air supply plenum 24 which separates the air supply plenum 24 from the belt passageway 30. Air is permitted to pass through the openings 14 and across the face of the infrared heaters 42 before impinging upon sludge 20 carried by the conveyor belt 18. Air passing through the openings 44 is heated as it crosses the face of the infrared heaters 32. The drying action is caused by infrared heat radiated from the infrared heaters 42, and also by the heated air which flows through the openings 44.

The conveyor belt 18 includes a drive motor 46 which moves the conveyor in a circuitous path.

To effectively dry sludge, it is necessary to remove moisture from the system. Moisture is removed from the system through an exhaust vent 48. Up to 30 percent of the air flowing through the system, and preferably between 10 and 30 percent of the air flowing into the air supply plenum 24 is diverted to the exhaust vent 48. This air is made up by ambient air flowing into the entrance opening 32 and exit opening 34 at opposite ends of the belt passageway 30. The air flowing into the entrance and exit openings 32 and 34 forms an air seal at the ends of the belt passageway 30 since air flowing into the openings 32 and 34 prevents air from flowing outwardly from the belt passageway 30.

Referring now to FIG. 1, a feed grate 50 is shown below the sludge depositing pipe 51. The full weight of the sludge 20 as it is deposited in the receiving station 14 is deflected by the feed grate 50. A weir 52 is provided at the receiving station 14 for leveling the upper surface of the sludge 20 prior to entry into the drying station 16.

Referring now to FIG. 1, the air supply duct 56 is shown interconnecting the fan plenum 28 to the air supply plenum 24. It is preferred that an air supply duct 56 be provided on both sides of the housing.

Return air plenum 58 is provided on the opposite end of the fan plenum and interconnects the return air plenum 26 to the fan plenum 28.

A filter 60 is preferably provided in the fan plenum 28 for removing particulates from the air flowing through the fan plenum 28. The filter 60 is preferably a high temperature oven filter formed of a metal mesh which is removable for cleaning as required.

The preceding description is of a preferred embodiment of the invention, and is intended to be by way of example and not by way of limitation. The scope of this invention should be construed in accordance with the following claims.

I claim:

1. A sludge drying apparatus for drying sludge comprising:

a housing defining a receiving station and a drying station;

an endless belt conveyor extending generally horizontally through said housing, said belt being formed by a porous screen and driven by a power drive, an upper run of said belt extending through said receiving station and said drying station;

means incorporated in said housing for recirculating air through an air supply plenum located above said conveyor in said drying station and a return air plenum which receives a first portion of returning air through ports formed in said return air plenum within the drying station, said ports being located below the belt, said return air plenum receiving a second portion of return air from first and second return air ducts, said first return air duct being located adjacent the conveyor between said receiving station and said drying station and said second return air duct being located adjacent the conveyor at the opposite end of said drying station from said receiving station, a fan plenum between said return air plenum and said air supply plenum, said fan plenum including a fan which pressurizes air in the air supply plenum and draws air through said return air plenum; and a plurality of infrared heat sources being disposed in said air supply plenum for radiating infrared heat onto the sludge conveyed by said conveyor through said drying station, said sources of infrared heat being mounted over openings in the air supply plenum through which air is directed toward the sludge on said conveyor.

2. In the sludge drying apparatus of claim 1, air flow between said first and second return air ducts is substantially equally balanced whereby air flow from said air supply plenum over the surface of the sludge on said conveyor is substantially equally drawn from both ends by said first and second air return plenums.

3. In the sludge drying apparatus of claim 1, said air supply plenum including an exhaust vent for exhausting up to 30 percent of the air flow to said air supply plenum to remove moisture from said apparatus, and said first and second return air ducts drawing makeup air from openings in said housing adjacent said first and second air return ducts.

4. In the sludge drying apparatus of claim 3, wherein said openings in said housing adjacent said first and second air return ducts comprise the openings in said housing through which said upper run of said conveyor moves as it enters and exits the drying station, said first and second air return ducts forming an air curtain by the movement of ambient air into the drying station so that air from said air supply plenum in said drying station is substantially precluded from exiting said drying station.

5. In the sludge drying apparatus of claim 1, wherein up to 15 percent of volume of air supplied to said air supply plenum is drawn from ambient air at opposite ends of the drying station.

6. In the sludge drying apparatus of claim 1, wherein a filter is disposed in said fan plenum to filter particulates from air recirculated through said sludge drying apparatus.

7. In the sludge drying apparatus of claim 1, wherein a feed grate is provided over said conveyor in said receiving station, said sludge being deposited on said feed grate prior to being deposited on said conveyor.

8. In the sludge drying apparatus of claim 1, wherein weir means are provided in said receiving station for leveling the sludge on the conveyor prior to movement of said sludge into said drying station by said conveyor.

9. In the sludge drying apparatus of claim 1, wherein a drain is provided below said receiving station for draining off water from said sludqe as it is separated from said sludge in said receiving station.

10. An air circulation system for drying sludge on a moving belt, said system comprising:

an air supply plenum on one side of said belt and having an opening in convection air supply relationship to sludge on said belt;

an air return plenum on the other side of said belt in convection air return relationship through the belt to said opening in said supply plenum;

said return plenum being spaced from said supply plenum to provide ingress and egress for said belt between said plenums and to form an air receiving connection to atmosphere;

infrared heating means spaced sufficiently from the opening in said air supply plenum to permit the circulation of convection air therethrough and in radiant heat relationship to sludge on said belt, whereby to dry said sludge by both convection and radiant heat;

an air circulation fan having an inlet in air return relationship to said return plenum, a first outlet in partial air supply relationship to said air supply plenum and a second outlet in partial air exhaust relationship to atmosphere; and said fan being in air receiving relationship with the connection to atmosphere between said supply and return plenums and operable to receive sufficient air from atmosphere through said connection to makeup for the partial exhaust to atmosphere from the second outlet of said fan and to prevent the exhaust of circulating air at said connection.

* * * * *